US006378979B1

(12) United States Patent
Anderson

(10) Patent No.: US 6,378,979 B1
(45) Date of Patent: Apr. 30, 2002

(54) POWER SHORT CIRCUIT DETECTION AND PROTECTION IN A PRINT SYSTEM

(75) Inventor: Daryl E. Anderson, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/727,435

(22) Filed: Nov. 30, 2000

(51) Int. Cl.[7] ..... B41J 2/01
(52) U.S. Cl. ..... 347/19
(58) Field of Search ..... 347/7, 19; 399/37, 399/29

(56) References Cited

U.S. PATENT DOCUMENTS 5,736,997 A * 4/1998 Bolash et al. ..... 347/19
6,109,714 A * 8/2000 Tsuruoka ..... 347/7
6,199,969 B1 * 3/2001 Haflinger et al. ..... 347/19

* cited by examiner

*Primary Examiner*—Craig A. Hallacher

(57) ABSTRACT

The present invention provides a short circuit detection system and method for determining a short circuit in a print system. The short circuit detection system includes a parameter sensing circuit in the print system, a parameter usage estimator, and a comparator. The parameter sensing circuit provides a sensed measurement of a predetermined parameter across the sensing unit. The parameter usage estimator is coupled to receive nozzle firing data and a desired unit parameter, and is used for determining an estimated parameter usage value. The comparator is coupled to receive the sensed measurement of the predetermined parameter and the estimated parameter usage value. The comparator determines if the sensed measurement of the predetermined parameter is greater than the estimated parameter usage value. If the sensed measurement of the predetermined parameter is greater than the estimated parameter usage value, the comparator outputs a signal indicating a short circuit condition.

17 Claims, 6 Drawing Sheets

POWER SHORT CIRCUIT DETECTION AND PROTECTION IN A PRINT SYSTEM

FIELD OF THE INVENTION

The present invention relates generally to printers, and more particularly to a method and apparatus for detecting and protecting against power short circuits in printers.

BACKGROUND OF THE INVENTION

An inkjet printer typically prints a plurality of rows of dots during the scanning of a movable print carriage across the print media. The print carriage typically has a plurality of printing devices such as inkjet print cartridges, which include a plurality of printing elements. These printing elements typically include a fluidic structure or chamber and a drop ejection device, typically a piezo-electric actuator or thin film resistor. The printing element typically displaces or boils the ink in the chamber and ejects it through a nozzle onto the print media. These printing elements are displaced relative to each other in the paper axis direction (orthogonal to the scanning axis), allowing the printing of a plurality of rows of dots. After the carriage scans across the media, it is advanced by a number of dot rows corresponding to the number of rows printed by the printhead. Page-wide array printers have fixed printheads and the print media is advanced while the stationary printhead prints.

Modern printers typically include printheads with large arrays of ink ejecting, elements to achieve high throughputs and faster printing speeds. Consequently they require very large power supplies with high current capability to drive each printhead while printing high density images or graphics. For the power supply to maintain a constant voltage while performing high density printing, it must provide high currents. If a short circuit occurs anywhere in the system, the power supply will overdrive the system and damage the drive electronics or print cartridges. Present solutions to this problem include placing short detection devices in the printhead and include placing "trip wires" in the ink's path. When a short occurs between the detection and power lines, a register is set that may be read by the printer.

However, short circuits may occur in the printer as well as on the printhead that are not detected by this "trip wire" scheme. Thus, there is a need for a method and system for detecting significant power short circuits that may cause serious damage wherein the detection method and apparatus may be used together with the current "trip wire" schemes to maximize the detection of short circuits and aid in the prevention of damage.

SUMMARY OF THE INVENTION

The present invention provides a short circuit detection system, typically for a printer or a printhead, for determining a short circuit therein. The system generally includes a parameter sensing circuit, a parameter usage estimator, and a comparator. The parameter sensing circuit is coupled between a printer supply output and a printhead. The parameter sensing circuit provides a measurement of a selected parameter that may change between the printer power supply and the printhead. The parameter estimator is coupled to receive nozzle firing data and a desired unit parameter, and is used for determining an estimated parameter usage. As used herein, the unit parameter is defined as the unit of the selected parameter per nozzle that is associated with firing a nozzle.

The comparator is coupled to receive the estimated parameter usage and the sensed parameter usage, typically determined between the printer power supply and the printhead. The comparator determines if the sensed parameter usage is greater than the estimated parameter usage, and if so, indicates a short circuit condition.

In one embodiment, the present invention provides a short circuit detection system for determining a short circuit, generally in a printer or printhead. The system may include a voltage or current sensing circuit, a voltage/current usage estimator, and a comparator. The voltage or current sensing circuit is coupled between a printer supply output and a printhead. The voltage or current sensing circuit provides a measurement of the voltage or current that may change between the printer power supply and the printhead. The voltage or current estimator is coupled to receive nozzle firing data and a desired unit voltage or unit current, and is used for determining an estimated voltage or current usage. As used herein, the unit voltage or unit current is defined as the voltage or current per nozzle that is associated with firing a nozzle.

The comparator is coupled to receive sensed voltage or current and the estimated voltage or current. The comparator determines if the sensed voltage or current is greater than the estimated voltage or current, and if the sensed voltage or current is greater than the estimated voltage or current, indicates a short circuit condition. In one implementation, the comparator may send a signal to set an error flag and set a flip-flop or register signal to indicate that a short circuit condition has occurred.

The voltage or current sensing circuit may include a resistor or other sensing device, which is coupled in series between the printer power supply output and the printhead, and which is used for facilitating measurement of a voltage or current across the resistor. The voltage or current sensing circuit also includes an amplifier or buffer that is coupled before and after the resistor. i.e., across the resistor, which is used for determining the voltage or current across the resistor.

In one embodiment, the parameter usage estimator may include a nozzle count logic unit, a unit parameter generator and a parameter multiplier unit. The nozzle count logic unit receives the nozzle firing data and determines how many nozzles will be fired. The unit parameter generator is coupled to receive a desired unit parameter value and to a parameter multiplier unit. The unit parameter generator generates a unit parameter value that is input into the parameter multiplier unit. The parameter multiplier unit is coupled to the nozzle count logic unit and the unit parameter generator, and is used for multiplying the number of nozzles to be fired times the unit parameter value. In addition, the parameter multiplier unit generally adds a predetermined guardband parameter value to provide the estimated parameter usage.

In one embodiment, the printer or printhead short circuit detection system may further include, as a short circuit indicator, a flip-flop, a register, or a flag indicator that is activated by the comparator when if the sensed parameter usage is greater than the estimated parameter usage to indicate that a short circuit has occurred. In addition, where desired, a trip wire system may be coupled to the short circuit indicator to maximize the detection of short circuits.

The present invention includes a method for detecting a short circuit, generally in a printer or printhead. The method includes the steps of: (1) using a sensing circuit for providing a measurement of a selected parameter across the sensing circuit; (2) utilizing a parameter usage estimator for determining an estimated parameter usage; (3) comparing the sensed parameter usage to the estimated parameter usage, and if the sensed parameter usage is greater than the estimated parameter usage, indicating a short circuit condition. In one embodiment, where the sensed parameter usage is greater than the estimated parameter usage, a signal may be sent to set an error flag, or set a flip-flop/register signal to indicate that the short circuit condition has occurred.

In one embodiment, a voltage or current sensing circuit may be implemented as the parameter sensing circuit, and the voltage or current sensing circuit may include a resistor that is coupled in series between a printer power supply output ad a printhead for facilitating measurement of a voltage or current across the resistor and using an amplifier or buffer that is coupled before and after the resistor for determining the voltage or current across the resistor.

Generally, using the parameter usage estimator includes: (1) using a nozzle count logic unit that receives nozzle firing data for determining a number of nozzles to be fired: (2) using a unit parameter generator for generating a unit parameter value; and (3) using a parameter multiplier unit for multiplying the number of nozzles to be fired times the unit parameter value and adding a predetermined guardband parameter value to provide the estimated parameter usage.

The method may further include storing one of: the error flag and information from the flip-flop or register signal to indicate that a short circuit has occurred. In addition, where desired, the step of storing one of the error flag and information from the flip-flop or register signal to indicate that a short circuit has occurred may further include receiving and storing signals from a trip wire system for short circuit detection.

In one embodiment, the present invention includes a method for detecting a short circuit in a printer or printhead. The method includes the steps of: (1) using a voltage or current sensing circuit for providing a measurement of voltage or current $V_A$ across a resistor from a printer power supply to the printhead; (2) utilizing a voltage or current usage estimator for determining an estimated voltage or current usage $V_B$; (3) comparing $V_A$ and $V_B$ to determine if $V_A>V_B$; and where $V_A>V_B$, one of: sending a signal to set an error flag and setting a flip-flop or register signal to indicate that a short circuit condition has occurred.

Typically, using the voltage/current sensing circuit includes using the resistor that is coupled in series between the printer power supply output and the printhead for facilitating measurement of a voltage/current across the resistor and using an amplifier/buffer that is coupled before and after the resistor for determining the voltage/current across the resistor.

Generally, using the voltage or current usage estimator includes: (1) using a nozzle count logic unit that receives nozzle firing data for determining a number of nozzles to be fired; (2) using a unit voltage or current generator for generating a unit voltage or current value; and (3) using a voltage or current multiplier unit for multiplying the number of nozzles to be fired times the unit voltage value and adding a predetermined guardband voltage value to provide the estimated voltage/current usage $V_B$.

The method may further include storing one of: the error flag and information from the flip-flop or register signal to indicate that a short circuit has occurred. In addition, where desired, the step of storing one of: the error flag and information from the flip-flop or resistor signal to indicate that a short circuit has occurred may further include receiving and storing signals from a trip wire system for short circuit detection.

In the present invention, the parameter measured may be voltage, current, electric field, power, temperature, or any other selected, desired measurable parameter.

Although the best mode of the short circuit detection system of the present invention is envisioned in the printer carriage, clearly the detection system may be implemented elsewhere in the printing system.

DETAILED DESCRIPTION OF THE PREFERRED EMBODIMENTS

The present invention provides a short circuit detection system typically for determining a short circuit in a print system so that a user may be alerted before the printer, printhead or part of the print system becomes so overheated that heat damage occurs. Though the best mode implements the short detection system in the print carriage, clearly the short detection system may be implemented where desired in the printing system.

Figure 1:
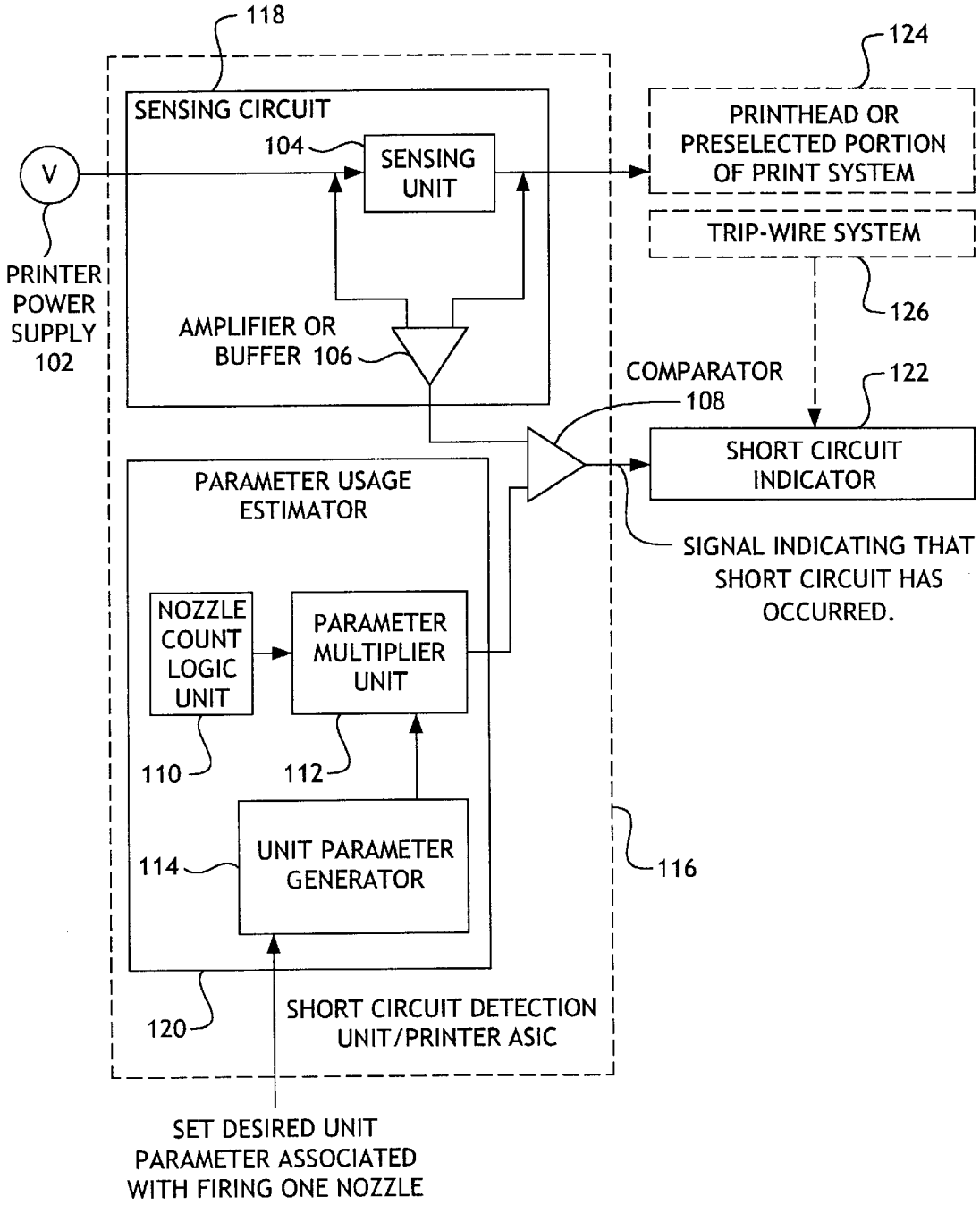
FIG. 1 is a block diagram of one embodiment of a short circuit detection system in accordance with the present invention.

FIG. 1 shows a block diagram of one embodiment of a short circuit detection system in accordance with the present invention. The system includes a parameter sensing circuit 118 a parameter usage estimator 120, and a comparator 108. The parameter sensing circuit 118 is typically coupled between a printer supply output 102 and a printhead 124. The parameter sensing, circuit 118 typically includes a sensing unit 104 with the comparator 108 coupled across the sensing unit 104 to measure the selected parameter across the sensing unit 104. This sensing circuit 118 allows a measurement of the selected parameter. The parameter usage estimator 120 is coupled to receive nozzle firing data and a desired unit parameter. The parameter usage estimator 120 uses the nozzle firing data and the desired unit parameter to determine an estimated parameter usage that will be used when the required nozzles fire. The unit parameter is defined as the parameter, e.g., voltage or current, per nozzle that is associated with firing a nozzle.

The comparator 108 is coupled to receive the sensed parameter measurement and the estimated parameter measurement, and determines whether the sensed parameter measurement is greater than the estimated parameter measurement. Where the sensed parameter measurement is greater than the estimated parameter measurement, the comparator indicates a short circuit condition. For example, in one embodiment, the comparator 108 may send a signal to set an error flag, or alternatively, in another embodiment, may set a flip-flop or register signal to indicate that a short circuit condition has occurred 122.

The parameter usage estimator 120 generally includes a nozzle count logic unit 110, a unit parameter generator 114, and a parameter multiplier unit 112. The nozzle count logic unit 110 is coupled to receive the nozzle firing data and determines a number of nozzles to be fired. The unit parameter generator 114 is coupled to receive a desired unit parameter value and to the parameter multiplier unit 112. The unit parameter generator 114 receives an input, typically from the user, and is used to generate a unit parameter value for the parameter multiplier unit 112. The parameter multiplier unit 112 is coupled to the nozzle count logic unit 110 and the unit parameter generator 114. The parameter multiplier unit 112 multiplies the number of nozzles to be fired times the unit parameter value and adds a predetermined guardband parameter value to provide the estimated parameter usage. The predetermined guardband parameter may be 10%, 20%. 30% or the like, of the parameter or a precise predetermined value—whatever respective amount that the user desires to use to allow the value of the estimated parameter to be sufficiently controlled with respect to the sensed parameter measurement. Where desired, the number of nozzles may be determined by a printer application specific integrated circuit (ASIC), or alternatively, via software. Once the number of nozzles is determined for each firing cycle, hardware (e.g., a comparator) or software may be used to compare the expected or estimated parameter value with the actual sensed value of the parameter. If the actual sensed value of the parameter exceeds the expected or estimated parameter value, a fault or error signal may be generated. Also, an ASIC may be used to implement the entire short circuit detection unit.

Where desired, the short circuit detection system may also include a flip-flop, a register, or a flag indicator 122 in order to allow the user to track short circuit occurrence. The flip-flop, register or flag indicator 122 is typically coupled to the comparator 108, for storing one of: the error flag and information from the flip-flop or register signal to indicate that a short circuit has occurred.

Where desired, the short circuit detection system may further include a trip-wire system 126, which may be coupled to the flip-flop, register, or flag indicator for detecting short circuits. Since trip-wire systems are known to those skilled in the art, such systems will not be further described herein.

The error flag information, the flip-flop information or register information may be used, for example, to initiate automatic shutdown of the printer, to illuminate a flashing warning light for the user, or the like, to provide notice of the short circuit. Thus, the selected parameter measurement may be used to determine whether a short circuit has occurred in the printer, printhead or printing system.

Figure 2:
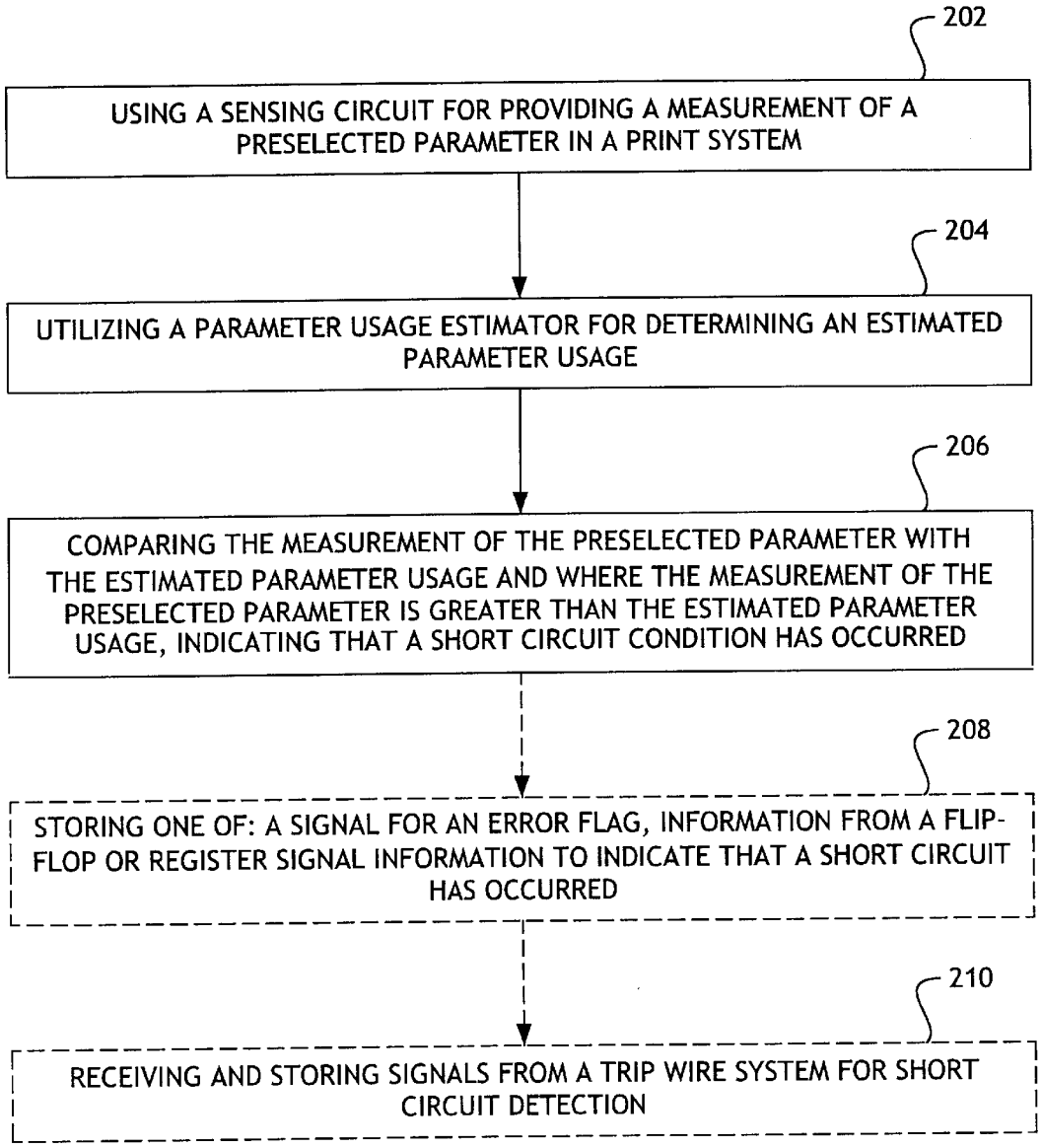
FIG. 2 is a flow chart showing one embodiment of steps in accordance with the method of the present invention.

FIG. 2 is a flow chart showing one embodiment of steps in accordance with the method of the present invention. The method detects a short circuit in a print system utilizing the steps of: using 202 a parameter sensing circuit for providing a measurement of the selected parameter across a sensing unit in the print system; utilizing 204 a parameter usage estimator for determining an estimated parameter usage; and comparing 206 the sensed parameter measurement with the estimated parameter usage to determine if the sensed parameter measurement is greater than the estimated parameter usage, and where the sensed parameter measurement is greater than the estimated parameter usage, indicating a short circuit condition. For example, a signal may be sent to set an error flag, a flip-flop may be set, or a register signal may indicate that a short circuit condition has occurred. Where selected, the method may include storing 208 one of: the error flag and information from the flip-flop or register signal to indicate that a short circuit has occurred. Where desired, the step of storing 208 one of: the error flag and information from the flip-flop or register signal to indicate that a short circuit has occurred may further include receiving and storing 210 signals from a trip wire system for short circuit detection.

Figure 3:
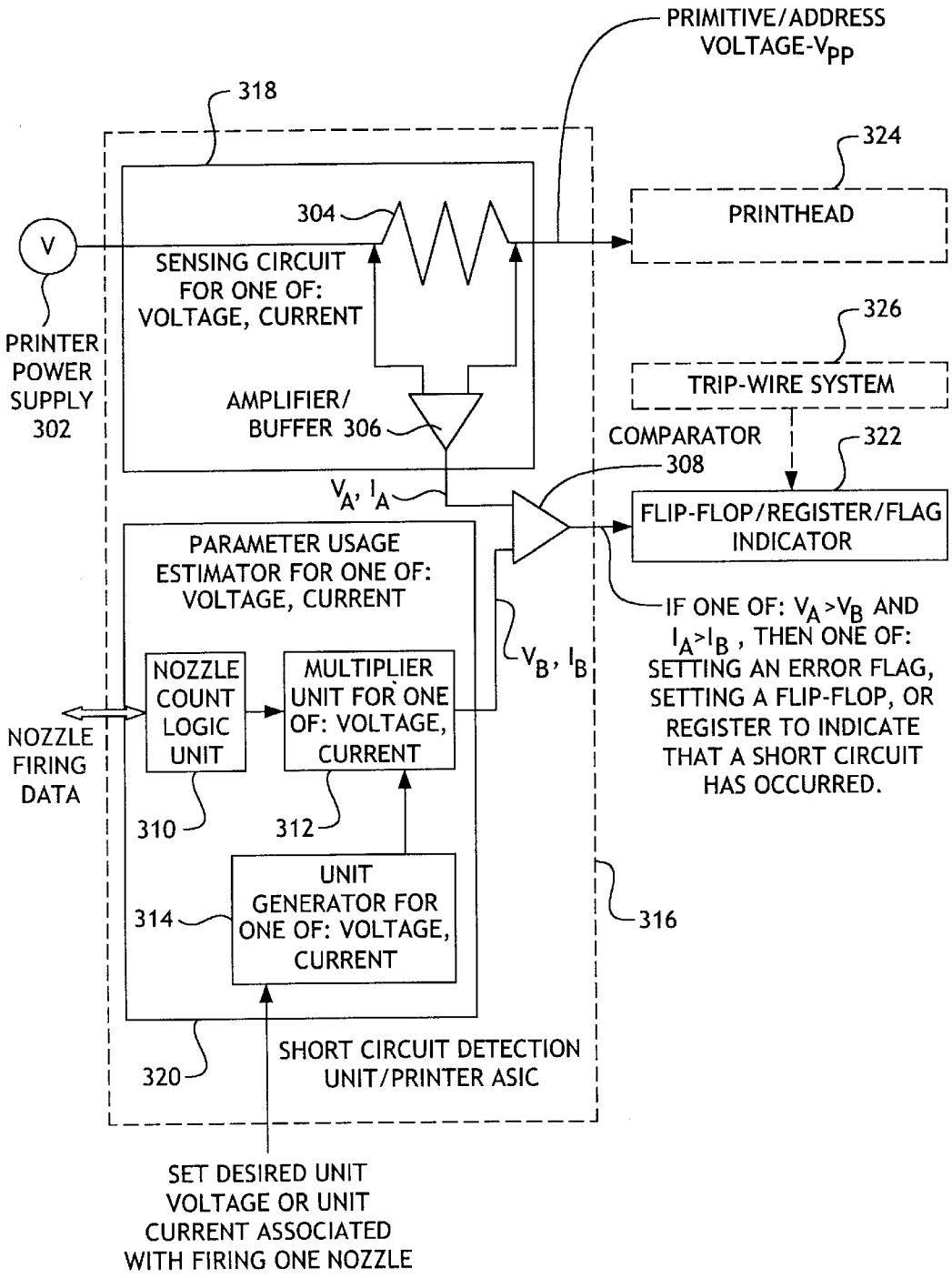
FIG. 3 is a block diagram of one embodiment of a short circuit detection system using voltage or current measurements in accordance with the present invention.

FIG. 3 shows a block diagram of an embodiment of the short circuit detection system wherein voltage or current is measured in accordance with the present invention. The system includes a voltage or current sensing circuit 318, a printer/printhead voltage or current usage estimator 320, and a comparator 308. The voltage or current sensing circuit 318 is coupled between a printer supply output 302 and a printhead 324. The voltage or current sensing circuit 318 typically includes a resistor 304 with the comparator 308 coupled across the resistor 304 to measure the voltage or current across the resistor 304. This sensing circuit 318 allows a measurement of the voltage $V_A$ or current $I_A$ flowing from the printer power supply 302 to the printhead 324 across the resistor 304. The voltage or current usage estimator 320 is coupled to receive nozzle firing data and a desired unit voltage or current. The voltage or current usage estimator 320 uses the nozzle firing data and the desired unit voltage or current to determine an estimated voltage $V_B$ or current $I_B$ usage that will be used when the required nozzles fire. As noted above, the unit voltage or unit current is defined as the voltage or current per nozzle that is associated with firing a nozzle The comparator 308 is coupled to receive $V_A$ and $V_B$ or $I_A$ and $I_B$, and determines whether $V_A>V_B$ or $I_A>I_B$. Where $V_A>V_B$ or $I_A>I_B$, the comparator 308 may send a signal to set an error flag, or alternatively, may set a flip-flop or register signal to indicate that a short circuit condition has occurred 322.

The voltage or current usage estimator 320 generally includes a nozzle count logic unit 310, a unit voltage or current generator 314, and a voltage or current multiplier unit 312. The nozzle count logic unit 310 is coupled to receive the nozzle firing data and determines a number of nozzles to be fired. The unit voltage or current generator 314 is coupled to receive a desired unit voltage or current value and to the voltage or current multiplier unit 312. The unit voltage or current generator 314 receives an input, typically from the user, and is used to generate a unit voltage or current value for the voltage or current multiplier unit 312. The voltage or current multiplier unit 312 is coupled to the nozzle count logic unit 310 and the unit voltage or current generator 314. The voltage or current multiplier unit 312 multiplies the number of nozzles to be fired times the unit voltage or current value and adds a predetermined guardband voltage or current value to provide the estimated voltage $V_B$ or current $I_B$ usage.

Where desired, the short circuit detection system may also include a flip-flop, a register, or a flag indicator 322 in order to allow the user to track short circuit occurrence. The flip-flop, register or flag indicator 322 is typically coupled to the comparator 308, for storing one of: the error flag, information from the flip-flop or register signal information to indicate that a short circuit has occurred. The short circuit detection system may further include a trip-wire system 326.

Figure 4:
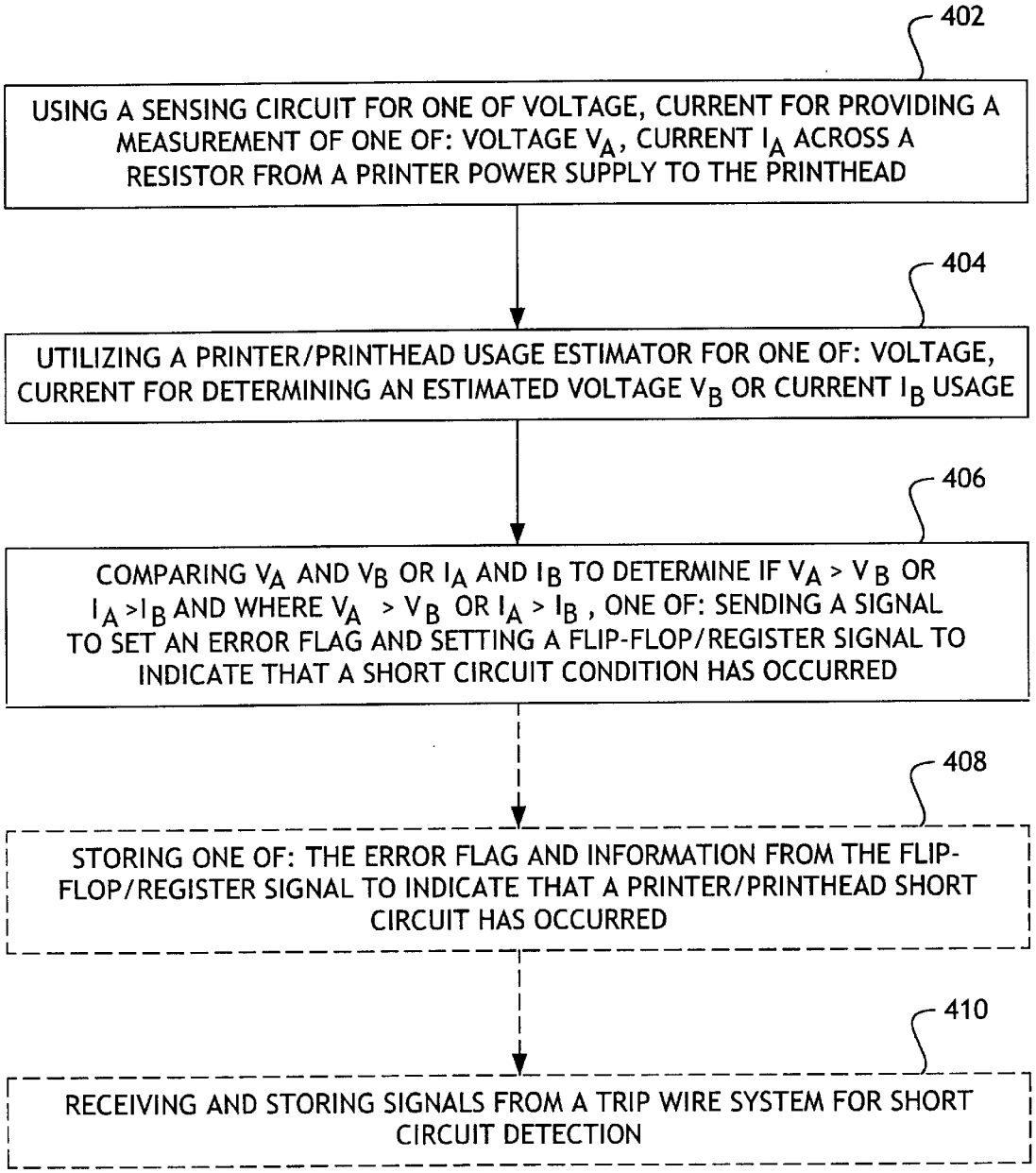
FIG. 4 is a flow chart showing one embodiment of steps for a method of short circuit detection using voltage or current measurements in accordance with the present invention.

FIG. 4 is a flow chart showing one embodiment of steps in accordance with the method of the present invention. The method detects a short circuit in a printer system utilizing the steps of: using 402 a voltage or current sensing circuit for providing a measurement of voltage or current $V_A$ across a resistor from a printer power supply to the printhead; utilizing 404 a voltage or current usage estimator for determining an estimated voltage $V_B$ or current $I_B$ usage; and comparing 406 $V_A$ and $V_B$ or $I_A$ and $I_B$ to determine if $V_A>V_B$ or $I_A>I_B$, and where $V_A>V_B$ or $I_A>I_B$, one of: sending a signal to set an error flag and setting a flip-flop/register signal to indicate that a short circuit condition has occurred. Where selected, the method may include storing 408 one of: the error flag, information from the flip-flop, or register signal information to indicate that a short circuit has occurred. Where desired, the step of storing 408 one of: the error flag, information from the flip-flop or register signal information to indicate that a short circuit has occurred may further include receiving and storing 410 signals from a trip wire system for short circuit detection.

Figure 5:
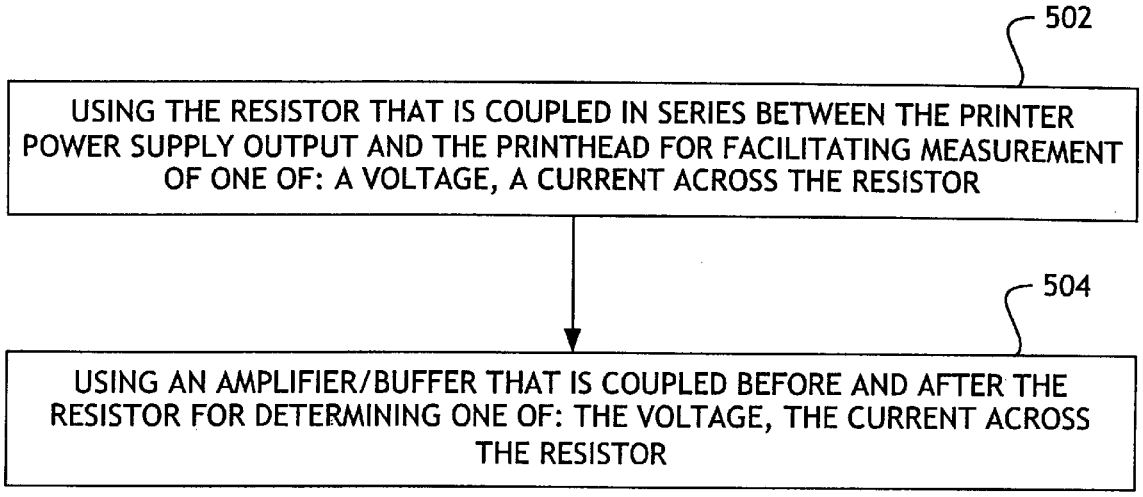
FIG. 5 shows one embodiment of steps for using a voltage or current sensing circuit in accordance with the present invention.

As shown in FIG. 5, one embodiment of steps for using the voltage or current sensing circuit in accordance with the present invention typically includes the steps of: using 502 the resistor that is coupled in series between the printer power supply output and the printhead for facilitating measurement of a voltage or current across the resistor and using 504 an amplifier or buffer that is coupled before and after the resistor for determining the voltage or current across the resistor.

Figure 6:
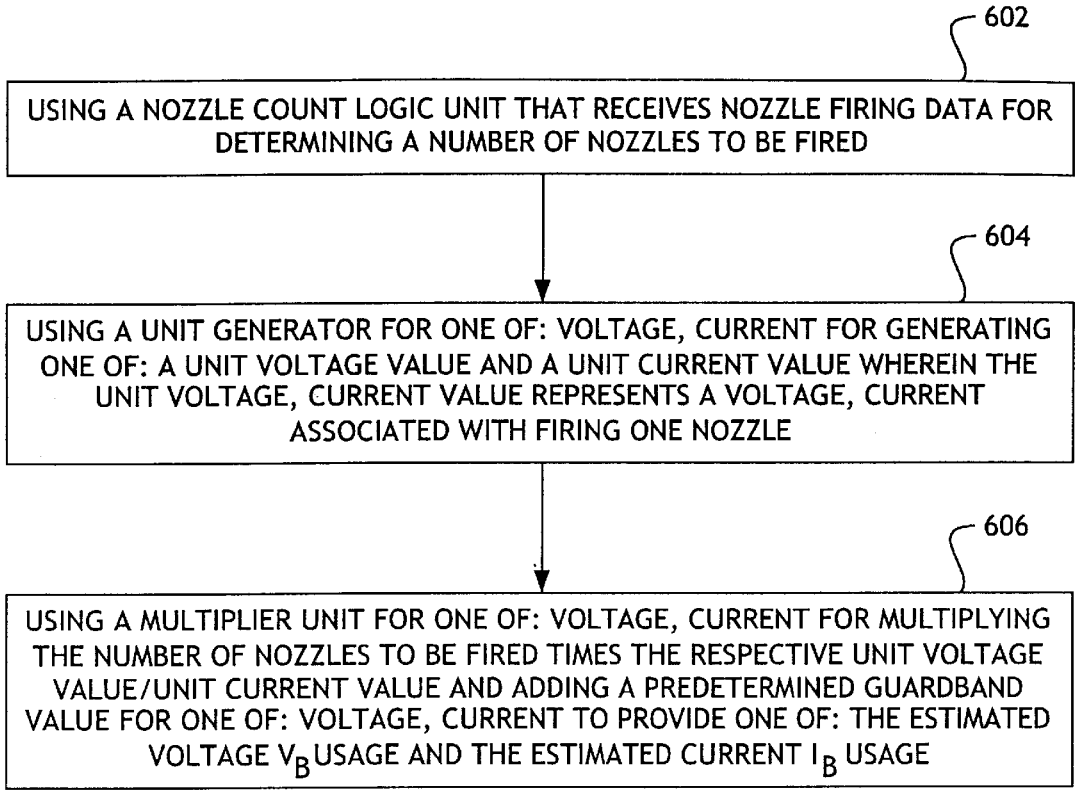
FIG. 6 shows one embodiment of steps for using the parameter usage estimator in accordance with the present invention.

As shown in FIG. 6, one embodiment of steps for using the voltage or current usage estimator in accordance with the present invention may include: using 602 a nozzle count logic unit that receives nozzle firing data for determining a number of nozzles to be fired using 604 a unit voltage or current generator for generating a unit voltage or current value; and using 606 a voltage or current multiplier unit for multiplying the number of nozzles to be fired times the unit voltage or current value and adding a predetermined guardband voltage or current value to provide the estimated voltage $V_B$ or current $I_B$ usage.

Although the present invention has been described in relation to particular preferred embodiments thereof, many variations, equivalents, modifications and other uses will become apparent to those skilled in the art. It is preferred, therefore, that the present invention be limited not by the specific disclosure herein, but only by the appended claims.

What is claimed is:

1. A short circuit detection system for determining a short circuit in a print system, comprising:

a parameter sensing circuit in the print system, for providing a sensed measurement of a predetermined parameter across the sensing unit;

a parameter usage estimator, coupled to receive nozzle firing data and a desired unit parameter, for determining an estimated parameter usage value; and a comparator, coupled to receive the sensed measurement of the predetermined parameter and the estimated parameter usage value, for determining if the sensed measurement of the predetermined parameter is greater than the estimated parameter usage value, and if the sensed measurement of the predetermined parameter is greater than the estimated parameter usage value, outputting a signal indicating a short circuit condition.

2. The short circuit detection system of claim 1 wherein the parameter sensing circuit is coupled between a printer supply output and a printhead.

3. The short circuit detection system of claim 1 wherein the parameter sensing circuit is in the printhead.

4. The short circuit detection system of claim 1 wherein the parameter is one of: voltage, current, electric field, energy and temperature.

5. The short circuit detection system of claim 1 wherein the parameter sensing circuit is one of: a voltage sensing circuit and a current sensing circuit and includes:

a resistor, coupled in series between a printer power supply output and a printhead, for facilitating measurement of one of: a voltage and a current across the resistor; and one of: an amplifier and a buffer, coupled before and after the resistor, for determining one of: the voltage and the current across the resistor.

6. The short circuit detection system of claim 1 wherein the parameter usage estimator includes:

a nozzle count logic unit, coupled to receive the nozzle firing data, for determining a number of nozzles to be fired;

a unit parameter generator, coupled to receive a desired unit parameter value and to a parameter multiplier unit, for generating a unit parameter value;

a parameter multiplier unit, coupled to the nozzle count logic unit and the unit parameter generator, for multiplying the number of nozzles to be fired times the unit parameter value and adding a predetermined guardband parameter value to provide the estimated parameter usage.

7. The short circuit detection system of claim 1 further including a short circuit indicator that is one of:

a flip-flop, a register, and a flag indicator; coupled to the comparator, for storing one of: the error flag, information from the flip-flop, and register signal information to indicate that a short circuit has occurred.

8. The short circuit detection system of claim 7 further including a trip wire system, coupled to the short circuit indicator for detecting short circuits.

9. A method for detecting a short circuit in a print system, comprising the steps of:

using a parameter sensing circuit for providing a measurement of a predetermined parameter across the parameter sensing circuit;

utilizing a parameter usage estimator for determining an estimated parameter usage;

comparing the measurement of the predetermined parameter and the estimated parameter usage to determine if the measurement of the predetermined parameter is greater than the estimated parameter usage; and where the measurement of the predetermined parameter is greater than the estimated parameter usage, outputting a signal indicating a short circuit condition.

10. The method of claim 9 wherein the signal indicating a short circuit condition is one of: a signal to set an error flag, a signal to set a flip-flop, and a register signal.

11. The method of claim 10 further including storing one of: the error flag, information from the flip-flop, and register signal information to indicate that a short circuit has occurred.

12. The method of claim 10 wherein the step of storing one of: the error flag, information from the flip-flop, and register signal information to indicate that a short circuit has occurred further includes receiving and storing signals from a trip wire system for short circuit detection.

13. The method of claim 9 wherein the parameter sensing circuit is a voltage sensing circuit and using the parameter sensing circuit includes using a resistor that is coupled in series between a printer power supply output and a printhead for facilitating measurement of a voltage across the resistor and using one of: an amplifier and a buffer that is coupled before and after the resistor for determining the voltage across the resistor.

14. The method of claim 9 wherein using the parameter usage estimator includes:

using a nozzle count logic unit that receives nozzle firing data for determining a number of nozzles to be fired;

using a unit parameter generator for generating a unit parameter value; and using a parameter multiplier unit for multiplying the number of nozzles to be fired times the unit parameter value and adding a predetermined guardband parameter value to provide the estimated parameter usage.

15. The method of claim 9 wherein the parameter sensing circuit is coupled between a printer supply output and a printhead.

16. The method of claim 9 wherein the parameter sensing circuit is in the printhead.

17. The method of claim 9 wherein the parameter is one of: voltage, current, electric field, energy and temperature.

* * * * *